US007753417B1

(12) United States Patent
Koughan

(10) Patent No.: US 7,753,417 B1
(45) Date of Patent: Jul. 13, 2010

(54) LOCK MANIPULATION DEVICE FOR DOOR OPERATOR

(76) Inventor: Roger Koughan, 6221 Granite Springs Rd., FairPlay, CA (US) 95684

( * ) Notice: Subject to any disclaimer, the term of this patent is extended or adjusted under 35 U.S.C. 154(b) by 0 days.

(21) Appl. No.: 12/231,085

(22) Filed: Aug. 29, 2008

(51) Int. Cl.
*E05C 19/18* (2006.01)
*E05C 19/00* (2006.01)

(52) U.S. Cl. ..... 292/288; 292/1; 292/348; 292/355; 292/DIG. 2; 70/202; 70/209; 70/212; 70/416

(58) Field of Classification Search ..... 292/1, 292/288, 347, 348, 355, DIG. 2; 70/202, 70/203, 209, 211, 212, 416
See application file for complete search history.

(56) References Cited

U.S. PATENT DOCUMENTS

| | | | | |
|---|---|---|---|---|
| 692,068 | A | 1/1902 | Patrick | |
| 3,593,548 | A | 7/1971 | Kendrick | |
| 4,236,396 | A | 12/1980 | Surko, Jr. et al. | |
| 4,570,470 | A * | 2/1986 | Gray, Sr. | 70/428 |
| 4,629,229 | A * | 12/1986 | Correnti et al. | 292/246 |
| 4,673,202 | A | 6/1987 | Willis | |
| 4,798,069 | A * | 1/1989 | DeForrest, Sr. | 70/428 |
| 4,947,663 | A | 8/1990 | Yeager | |
| 5,000,498 | A | 3/1991 | Upchurch | |
| 5,003,803 | A | 4/1991 | Richards | |
| 5,052,202 | A | 10/1991 | Murphy | |
| 5,140,843 | A | 8/1992 | Krueger | |
| 5,313,812 | A | 5/1994 | Eklund et al. | |
| 6,029,484 | A * | 2/2000 | Jetton | 70/371 |
| 6,742,369 | B1 | 6/2004 | Veillette | |
| 6,929,292 | B1 | 8/2005 | Galindo et al. | |
| 7,000,955 | B2 * | 2/2006 | Heyder | 292/159 |
| 7,048,315 | B2 | 5/2006 | Wong | |
| 7,334,824 | B2 * | 2/2008 | Sundberg et al. | 292/336.3 |

* cited by examiner

*Primary Examiner*—Carlos Lugo

(57) ABSTRACT

A locking/unlocking device usable with a door operator having a tapered shaft including a first element possessing a surface with a recess. A second element also includes a surface such that a fastener removably holds the first element to the second element to form a unit. The unit includes an aperture formed by the recess to at least partially circumscribe the tapered shaft of the door opener. A moveable foot located on the unit is driven against the door to allow the door operator to be positioned between a locked and unlocked orientation.

2 Claims, 3 Drawing Sheets

LOCK MANIPULATION DEVICE FOR DOOR OPERATOR

BACKGROUND OF THE INVENTION

The present invention relates to a novel and useful locking device for a door operator.

In the past, door locks have been employed in which only a key is able to lock or unlock the door. Typically, the key slot appears on one side of the door, normally exterior to the room being locked. A knob or lever appears on the opposite side of the door within the space secured, requiring a person within the space to exit the same and use a key to effect the locking or unlocking process. It is apparent that this system is very inefficient and very impractical since the person locking the space must exit the space to accomplish the unlocking or locking maneuver. Alternatively, the user may keep the door in the locked position but must open the door from the inside of the space by turning of lever, to let persons in and out of the space when necessary. The lever returns to its locked position after each unlocking due to a dead latch spring.

Many systems concerning door locks have been proposed in the past. For example, U.S. Pat. No. 4,236,396 shows a retrofitable lock which adds a deadbolt to the locking system in replacement of a conventional lock set.

U.S. Pat. No. 692,068 shows a combined lock and latch in which a thumb operated bar or spindle prevents draw back of a latch bolt.

U.S. Pat. No. 5,140,843 describes a lock conversion mechanism in which a key holder cup fits on the outside of a cylinder deadbolt to prevent the removal of the key once it is in the deadbolt.

U.S. Pat. Nos. 3,593,548, 4,673,202, 4,947,663, 5,003,803, 5,313,812, and 6,742,369 illustrate deadbolt keepers or holders that are mounted near the deadbolt latch and physically prevent rotation of the same when moved into an operative position.

U.S. Pat. Nos. 5,000,498 and 5,052,202 teach deadbolt latch holders that use a wedging mechanism directly to the latch or indirectly to the latch.

U.S. Pat. Nos. 4,798,069, 6,929,292 and 7,048,315 propose axillary locking mechanisms that employ a stop mounted at the door near a lever operator in order to interfere with the rotatable motion of the lever.

A locking device for a door which is easy to install on a conventional lock set and easily controls the lock state of the door would be a notable advance in the security field.

BRIEF SUMMARY OF THE INVENTION

In accordance with the present invention a locking/unlocking device for a door operator is hereinafter described.

The device of the present invention utilizes a first element and a second element at least one of which has a recess. A fastener removably holds the first and second elements together to form an aperture utilizing the recess. The unit formed by the first and second elements is used to at least partially circumscribe the shaft of the door operator at the aperture. The unit is also supplied with one or more feet that are moveable along openings in the unit and outwardly from the unit. When the unit is positioned on the shaft of the operator of the door, the feet are capable of applying a force to the door. In this regard, a driver urges the movement of any one of the feet outwardly from the unit to establish such a force on the door. Such movement wedges the unit along the tapered shaft of the operator providing enough friction to allow the lever or grip associated with the shaft to move and remain at multiple positions. Such multiple positions would correspond to the locked or unlocked state of the door.

In certain embodiments, the first and second elements may be rotatably fixed to each other and a recess would be formed in both the first and second elements. A fastener would then maintain the encompassing orientation of the unit about the shaft of the door operator to allow the movement outwardly from the door along the axis of the shaft. It should be noted that the driver may take the form of set screws which move along threaded bores and press on the feet to extend the same from the unit as needed. Of course, other means may be employed to move the door engaging feet, such as spring loaded devices, frictional devices, and the like.

It should be realized that a novel and useful locking device usable with a door operator has been hereinabove described.

It is therefore an object of the present invention to provide a locking device for a door which easily installs on a conventional door operator in a locked or unlocked position.

Another object of the present invention is to provide a locking device for a door operator which permits the operator to be positioned in a locked or unlocked position and to easily move from one position to the other.

Another object of the present invention is to provide a locking device for a door operator which is durable and easy to manufacture.

It another object of the present invention is to provide a locking device for a door operator which is easy to install on a conventional lock set and may be quickly and positively placed into operation using a simple hand tool.

A further object of the present invention is to provide a locking device usable with a conventional door operator that saves time and labor formerly associated with operation of the door lock.

The invention possesses other objects and advantages as specially as concerns particular characteristics and features thereof which will become apparent as the specification continues.

Figure 1:
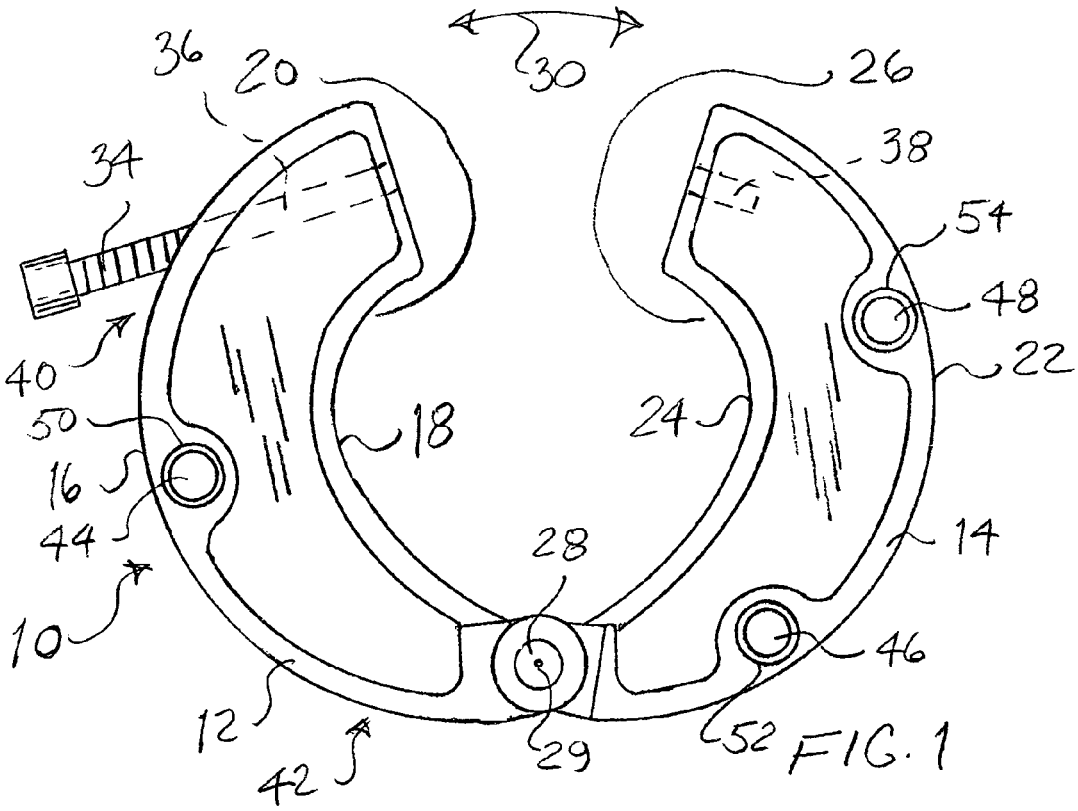
FIG. 1 is a rear elevational view of the device of the present invention in its open position.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments, thereof which should be referenced to the prior described drawings.

An embodiment of the invention is shown in the drawings shown by reference character 10. The door locking/unlocking device 10 includes a first element 12 and a second element 14. Element 12 includes an outer surface 16 and an inner surface 18. Inner surface 18 is contoured to form a recess 20. Likewise, second element 14 possesses an outer surface 22 and an inner surface 24.

Again, inner surface 24 defines a recess 26. Elements 12 and 14 may be formed of any rigid or semi-rigid materials such as metal, plastic, ceramic compositions, and the like, FIGS. 1 and 2. Pivot pin or axle 28 rotatably holds first element 12 to second element 14 along axis 29, to allow the separation and closure of element 12 relative to element 14 according to directional arrow 30, FIG. 1.

Referring again to FIG. 2, it may be observed that the rotation of element 12 into a position adjacent to element 14 forms an aperture 32, whose purpose will be described in greater detail hereinafter. A fastener 40, in the form of a threaded screw 34, passes through opening 36 of first element 12 and engages a threaded opening 38 within second element 14. Thus, threaded screw 34 and openings 36 and 38 serves as a fastener 40 for removably holding first element 12 to second element 14. It may be apparent that the connection of first element 12 to second element 14 through pin 28 and fastener 34 creates a unit 42, the function of which will be revealed as the specification continues.

Figure 2:
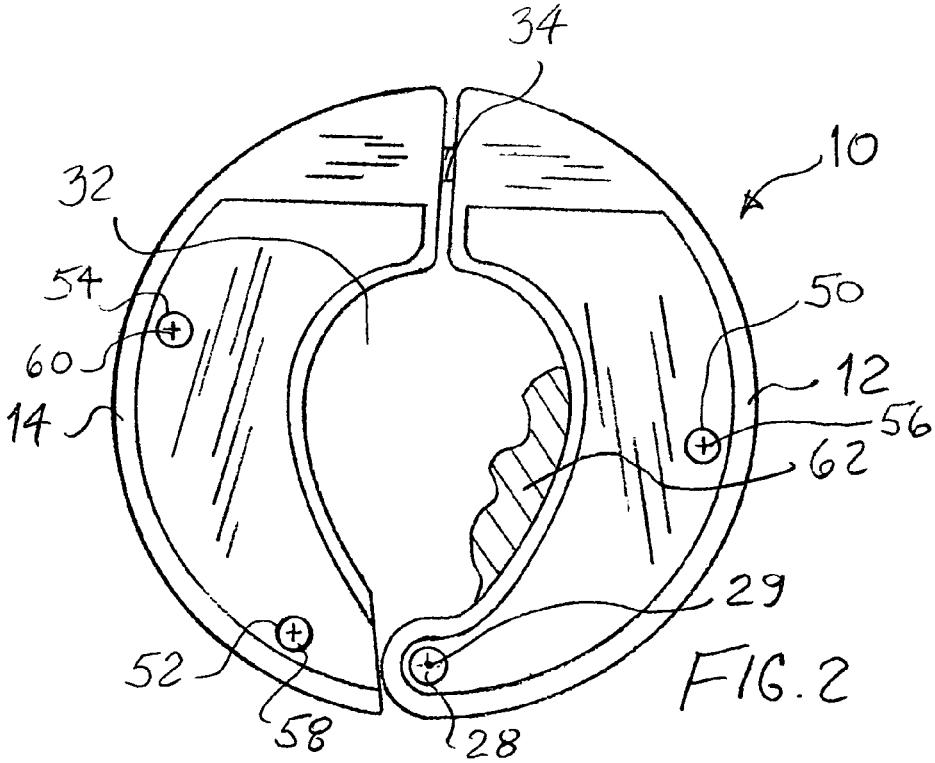
FIG. 2 is a front plan view of the device of the present invention in its closed position.

Device 10 also includes feet 44, 46, and 48 which are slidingly moveable within bores 50, 52, and 54, respectively (rear side) FIG. 1. Feet 44, 46, and 48 may be cylindrical members formed of a suitable load bearing material such as polyurethane, and the like. It should be noted that bores 50, 52, and 54 on the rear side, FIG. 1 step down in size from the openings afforded feet 44, 46, and 48, in the opposite, to the openings on the front side of unit 42, FIG. 2. Such a structure retains set screws 56, 58, and 60 within bores 50, 52, and 54, respectively. Thus, such set screws 56, 58, and 60 function as drivers urging the movement of feet 44, 46, and 48 outwardly from unit 42 and permitting the retreat of feet 44, 46, and 48 into unit 42 as the case may be.

Figure 3:
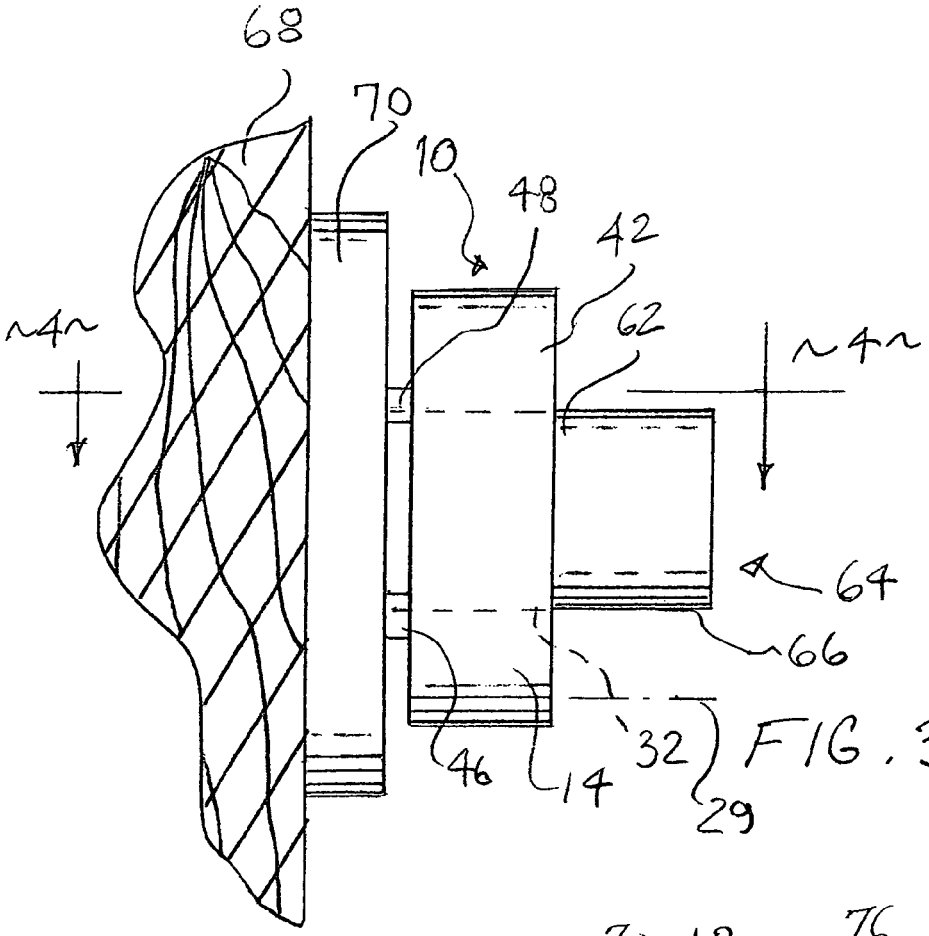
FIG. 3 is a side elevational view of the device in place on a conventional door operator with the door being depicted in sections.
Figure 4A:
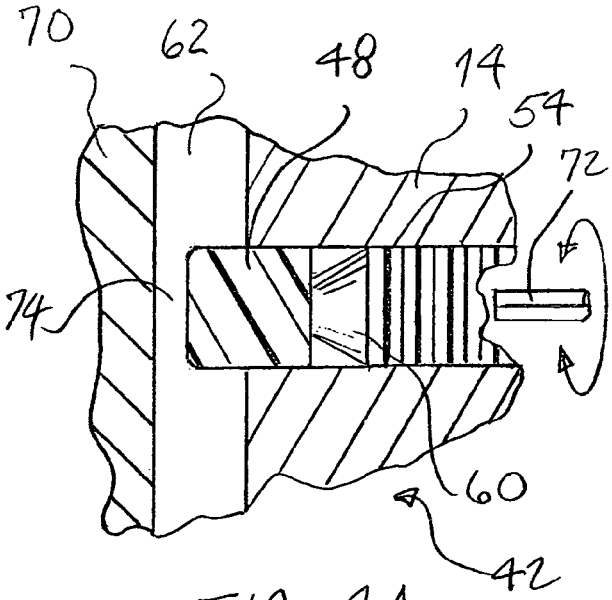
FIG. 4A is a sectional view taken along line 4-4 of FIG. 3 showing the foot of the locking device of the present invention separated from the door.
Figure 4B:
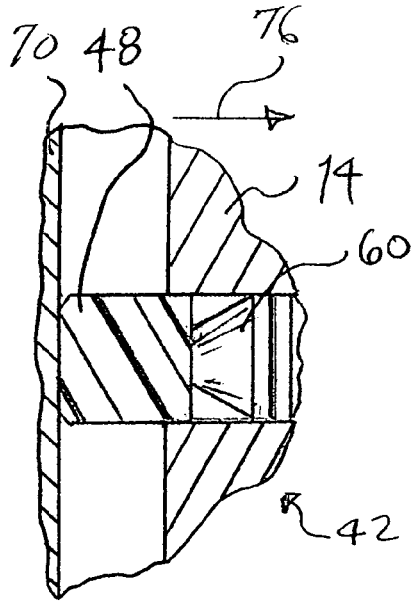
FIG. 4B is a sectional view showing a foot associated with the device of the present invention in contact with the rosette fixed to the door.

Referring to FIG. 3, it may be apparent that device 10, specifically unit 42, has been mounted on a tapered shaft 62 of a door operator 64 having a lever end portion 66. It should be noted that door operator 64 is of an conventional configuration such that the cross-sectional size of shaft 62 increases as it extends away from door 68. FIGS. 4A and 4B demonstrate the movement of exemplary foot 48 with bore 54. It may be observed in FIG. 4A, set screw 60 has been brought to bear on foot 48 by the use of tool 72 which may be an wrench, screwdriver, and the like. Foot 48 is not touching on door 68, via rosette 70, as is evidenced by gap 74. FIG. 4B indicates that set screw 60 has been advanced within bore 54 such that foot 48 now contacts rosette 70 and exerts a force on door 68 thereby. Unit 42 moves away from door 68 and rosette 70 according to directional arrow 76, wedging unit 42 along shaft 62 of door operator 64. Such wedging action affects the operation of door operator 64 in that the return spring mechanism normally associated therewith to rotate lever 66 has been overridden by device 10.

Figure 5:
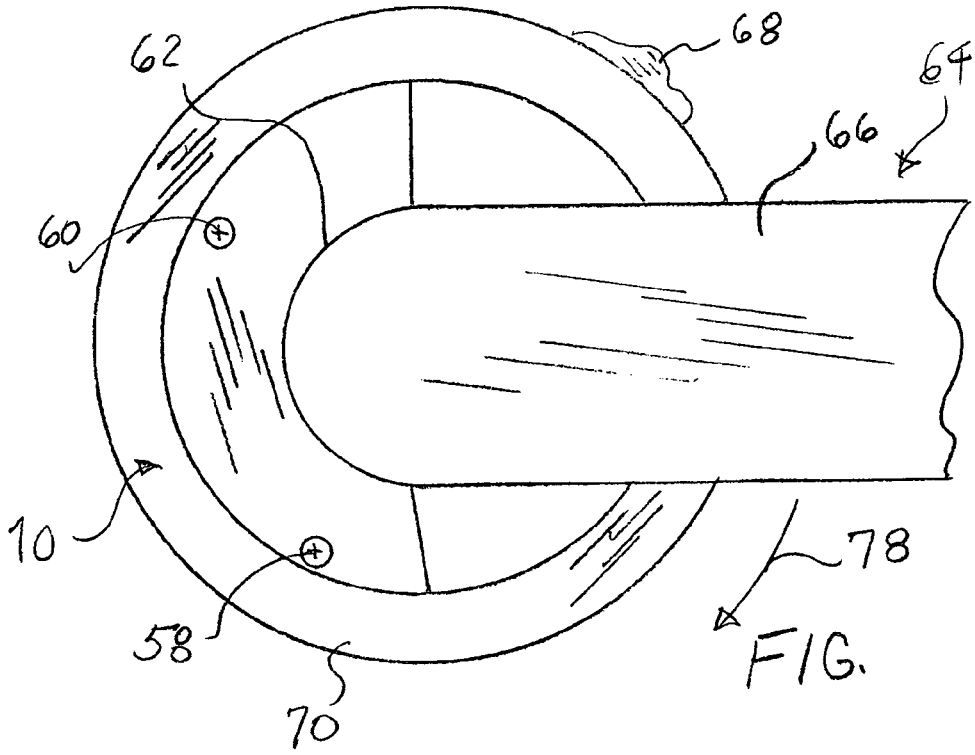
FIG. 5 is a front elevational view of a conventional lock set with the device of the present invention in place and the lever of the lock set in its locked position.
Figure 6:
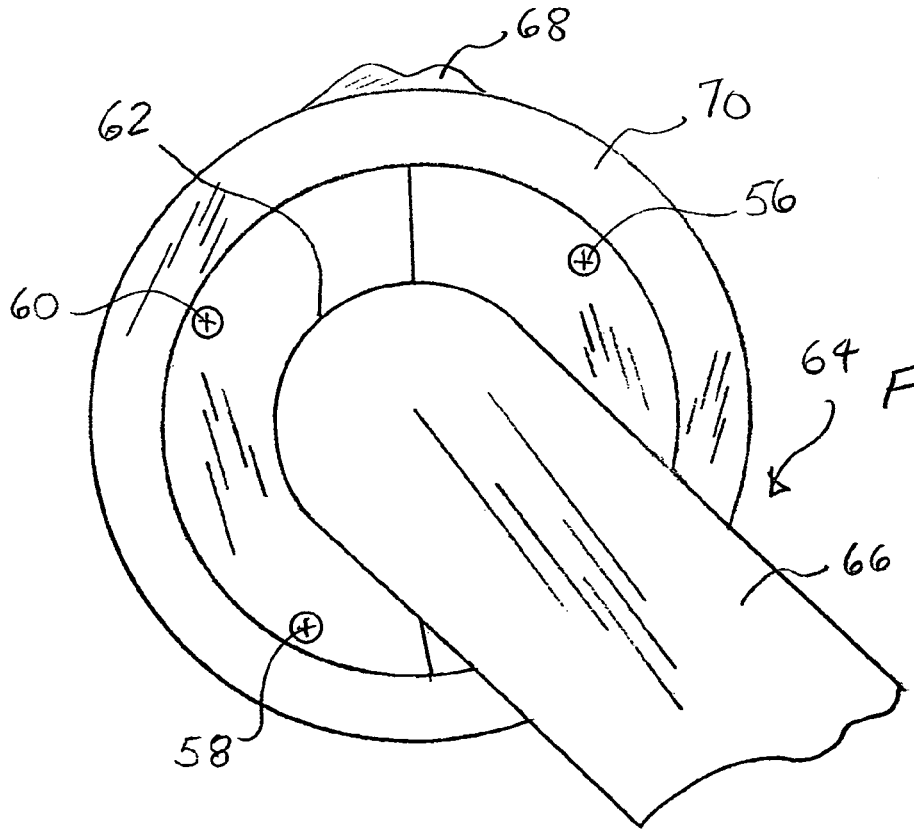
FIG. 6 is a front elevational view of a lock set with a device of the present invention in place and the lever of the lock set located in its unlocked position.

In operation, FIGS. 5 and 6 show a fully wedged device 10 on shaft 62 of door operator 64. Door operator 64, via lever 66 is depicted in its locked position, FIG. 5. That is to say, the keyed (not shown) lock associated with door operator 64 has been locked by the user of device 10 such that door 68 locks a space associated therewith. Door operator 64 via lever 66 may then be turned according to directional arrow 78 to its unlocked position depicted, in FIG. 6, and held there at by feet 44, 46 and 48. Again, the spring mechanism that normally returns lever 66 to the position shown in FIG. 6 has been overcome by the frictional engagement of device 10 on shaft 62 of door operator 64 and the force exerted by feet 44, 46, and 48 against door 68 via rosette 70. Consequently, door 68 may then be freely opened without unlocking the lock set normally associated with door operator 64. Lever 66 may again be returned manually to the position of FIG. 5 (locked) since feet 44, 46 and 48 allow such movement. Of course the frictional contact of feet 44, 46 and 48 may be adjusted by tool 72 to allow lever 66 to assume the positions of FIGS. 5 and 6 without binding.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A lock maneuvering device useable with a door, and a door operator having tapered shaft and a return spring, in conjunction with a door lock on one side of the door, a. a first element having a surface with a recess;

b. a second element having a surface with a recess, c. a fastener for removably pivotally holding said first element to said second element to form a unit, said unit having an aperture including said recesses of said first and second elements, said unit aperture at least partially circumscribing the tapered shaft of the door operator;

d. a first foot supported in a bore of said first element;

e. a second foot supported in a bore of said second element, said first and second feet each being movable relative to said unit and;

f. first and second drivers positioned in said bores supporting said first and second feet, respectively, said first and second drivers urging said first and second feet outwardly, respectively, relative to said unit to exert a force on the door, wherein said forces urging said unit toward the door operator to exert a wedging action against the door operator tapered shaft, to affect the operation of a return spring of the door operator to allow operation of the door operator when the door operator is locked from one side of the door, without unlocking the door lock.

2. The device of claim 1 in which each of said bores includes a threaded portion, and said first and second drivers threadingly engaging said threaded portion of each of said bores.

* * * * *